United States Patent [19]

Yonezawa et al.

[11] Patent Number: 4,827,839

[45] Date of Patent: May 9, 1989

[54] HYDRAULIC OVERLOAD PROTECTOR FOR MECHANICAL PRESS

[75] Inventors: Keitaro Yonezawa; Masatake Miyajima, both of Amagasakishi, Japan

[73] Assignee: Kabushiki Kaisha Kosmek, Hyogoken, Japan

[21] Appl. No.: 105,033

[22] Filed: Oct. 6, 1987

[30] Foreign Application Priority Data

Oct. 9, 1986 [JP] Japan ..... 61-240881

[51] Int. Cl.[4] ..... B30B 15/28

[52] U.S. Cl. ..... 100/53

[58] Field of Search ..... 192/150; 100/53, 269 R, 100/49, 257

[56] References Cited

U.S. PATENT DOCUMENTS 4,085,669 4/1978 Yonezawa ..... 100/53
4,166,415 9/1979 Spanke et al. ..... 100/257
4,289,066 9/1981 Proga ..... 100/53
4,456,112 6/1984 Jones, Jr. ..... 100/53 X
4,677,908 7/1987 Imanishi et al. ..... 100/53

*Primary Examiner*—Andrew M. Falik
*Attorney, Agent, or Firm*—Lowe, Price, LeBlanc, Becker & Shur

[57] ABSTRACT

A hydraulic overload protector for a mechanical press is provided with a cylindrical operational oil chamber which is formed in a vertical direction. A piston is vertically slidably inserted into a slide. The operational oil chamber is provided with a friction-contacting cylinder. During press operation, the hydraulic pressure of the operational oil chamber fixes the slide to the piston at a predetermined force through the friction-contacting cylinder, so that a pressing force is transmitted from the piston to the slide from an overload. When the slide is overloaded by foreign matter, the piston slides downwards in the slide in resistance to the piston-fixing force, whereby an overload-safe operation is effected.

9 Claims, 4 Drawing Sheets

HYDRAULIC OVERLOAD PROTECTOR FOR MECHANICAL PRESS

BACKGROUND OF THE INVENTION

The present invention relates to a hydraulic overload protector for a mechanical press, which incorporates subject matter disclosed in the present inventor's U.S. Pat. No. 4,085,669 described with reference to the schematic flow diagram shown in FIG. 6. An overload protector for a mechanical press according to U.S. Pat. No. 4,085,669 comprises a cylinder chamber 213 formed in a slide 207, a piston 214 provided in the cylinder chamber 231 so as to be vertically movable therein, and a disk shaped operational oil chamber 215 formed between the piston 214 and the slide 207. Specifically, the operational oil chamber 215 is formed between the bottom surface of the cylinder chamber 213 and the bottom surface of the piston 214. This construction allows the oil pressure in the oil chamber 215 to raise the piston relative to the slide to the top dead center of the cylinder chamber 13 and to press the slide 207 down against the piston 214.

In the top dead center position, the top and bottom molds are operationally spaced from each other to receive material therebetween and process same into a desired thickness. In the event that extraneous material or substance enters between the molds and is of a thickness greater than the spacing of the top and bottom molds, the slide will displace in relation to the piston 214 by relative descending movement of the piston to a bottom dead center position within the cylinder chamber 13.

Operational oil is compressed into the operational chamber 215 by a booster pump 217 and a pneumatic supply valve 218 which sets the pressure of the operational oil to a predetermined value. When the load applied to the slide 207 is greater than the predetermined value, the operational oil in the chamber 215 is discharged into an oil tank 220 through an overload protector 219, whereby the descending power of the piston 214 is absorbed by the compressive operation of the operational oil chamber 215 so as not to press the slide 207 for a safe overload operation. A pressure-safety valve 221 prevents the abnormal rise of the pressure caused by the rising temperature of the operational oil. A pressure switch 222 interlocks the movement of the mechanical press with the hydraulic overload protector.

The conventional construction described have has the following disadvantages:

(1) The operational oil, mixing with air, is likely to have compressibility and the accuracy in the bottom dead center of the slide 207 becomes impaired thereby causing the thickness in the press forged or embossed plastic products to vary and become inaccurate.

(2) To prevent impairment of the processing accuracy in the thickness direction as described above requires the lowering of the height of the operational oil chamber 215, with the result that the strokes of the overload safety operation between the piston 214 and the slide 207 become small. Therefore, when a small extaneous substance enters in between an upper metallic mold and a lower one or between the slide-beds of the press, it cannot be absorbed by the small strokes described above and the overload safety operation becomes impossible.

(3) Since the piston 214 and the slide 207 make relative movements during the overload safety operation, a packing 223 in the gap between the piston 214 and the slide 207 is short-lived due to the friction therebetween, and as such, the frequency of replacement of these members is high.

(4) Since a considerable amount of operational oil is discharged from the operational oil chamber 215 during the overload-safe operation, the oil passage 224 and overload-safe valve 219 experience high back-up pressure and a time lag arises in the safe operation, thereby imposing an overload on the mechanical press.

(5) Since the operational oil chamber 215 must be refilled in great quantity after the over-load safe operation, the booster pump 217 and the oil tank 220 require heavy equipment to achieve proper hydraulic pressure.

SUMMARY OF THE INVENTION

It is therefore the object of the present invention to provide a hydraulic overload protector for a mechanical press which does not have the aforementioned disadvantages.

A hydraulic overload protector for a mechanical press according to the present invention comprises a cylinder chamber formed in the slide for the mechanical press, a piston vertically movable in the cylinder chamber, and an operational oil chamber formed between the piston and the slide wherein the piston is fixed to the slide at the top dead center of the cylinder chamber by the hydraulic pressure in the operational oil chamber. In accordance with the invention the operational oil chamber is vertically cylindrical, and the inner circumferential face or the outer circumferential face of the cylindrical operational oil chamber is sealed with a friction-contacting cylinder. The friction-contacting cylinder slidably contacts with a friction-contacting circumferential face, and the friction-contacting cylinder is fixed to the slide or the piston and the friction-contacting circumferential face is fixed to the slide or the piston so as to frictionally fix the slide to the piston by pressing the friction-contacting cylinder onto the friction-contacting circumferential face by means of the hydraulic pressure of the operational oil chamber.

According to the present invention, compressed oil is supplied from a hydraulic supply unit to an operational oil chamber at a predetermined pressure with a piston positioned at the top dead center of a cylinder chamber. As a result, the hydraulic force allows a friction-contacting cylinder to contact with the friction-contacting circumferential face, with the result that the slide is frictionally fixed to the piston through the friction-contacting cylinder at a predetermined force.

When the slide is overloaded by an overload force acting against the slide through a top mold of the press, the force which presses the slide to the piston is overcome by the overload force thus applied, with the result that the slide moves (i.e. sliding occurs between the friction-contacting cylinder and the friction-contacting circumferential surface of the piston.

A safe overload operation is carried out owing to the slide between the friction-contacting cylinder and the friction-contacting circumferential surface at a high speed. Since no resistance is imparted to this operation, the responsive sensitivity is high and no overload arises due to a delay in the operation.

In order to carry out a reset operation after the overload-safe operation, the hydraulic pressure is released from the operational oil chamber and the hydraulic pressure is re-applied thereto after the piston is returned to the top dead center thereof. Since the operational oil for filling in and releasing from the operational oil chamber can be limited to a small amount equivalent to that which has been compressed, a hydraulic supply unit can be smaller in size and the resetting operation can be quickly performed.

The following advantages can be obtained by the construction and operation described above:

(1) Since the slide is firmly fixed to the piston by the friction force between the friction-contacting cylinder and the friction-contacting circumferential surface, the slide does not move due to press reaction. Therefore, the accuracy of the bottom dead center of the slide is high and that of the thickness direction in plastic products of forging and embossing increases.

(2) The strokes of the overload-safe operation between the slide and the piston can be determined free from the processing accuracy of the thickness direction in press moldings. Accordingly, even when foreign matter gets between the slide and the die-bolster or between the top and bottom metal molds, the overload-safe operation is possible.

(3) Since the contact portion between the friction-contacting cylinder and parts which support it is sealed by a gasket and the gasket resists wear replacement is almost unnecessary.

(4) The high-speed overload-safe operation due to the smooth sliding between the friction-contacting cylinder and the friction-contacting circumferential surface allows high precision in the operation with no delay in actuation.

(5) Since the amount of oil for supply and exhaust in the operational oil chamber is limited to that which has been compressed, the fill and drain of oil in the operational chamber rapidly occurs. Accordingly, resetting after the overload-safe operation can be quickly performed.

(6) The small amount of operational oil described above allows the hydraulic supply device to be small in size, i.e., the sizes of hydraulic equipment such as a hydraulic pump, an oil tank, a supply-exhaust passage, a safety valve, a pressure-safe valve are allowed to be small.

Further, the above-described hydraulic booster pump can be substituted by a booster in a simple structure, and the omission of the overload-safety valve is possible by the use of the pressure-safety valve also serving as the overload safety valve.

(7) The large or small mechanical press determines the capability of the overload-safe equipment, but since the supply-exhaust oil for the over-load safe equipment is basically a small amount, the amount used does not significantly impact on the equipment size. Therefore, hydraulic supply devices in the same capability can be applied to a number of overload-safe equipment in different levels of capability, so that the common use of hydraulic supply devices is conceivable.

BRIEF DESCRIPTION OF THE DRAWINGS

FIGS. 1 and 2 indicate one aspect of the embodiments.

FIG. 1 is an enlarged sectional view of principal portions shown in FIG. 2.

FIG. 2 is a partial sectional side view of a mechanical press.

FIG. 3 is a sectional view of a modified embodiment corresponding to that illustrated in FIG. 1.

FIG. 4 illustrates another sectional view of a further embodiment corresponding to that shown in FIG. 1.

FIG. 5 is yet another sectional view of a further embodiment shown in FIG. 4.

DESCRIPTION OF THE PREFERRED EMBODIMENTS

The present invention will become more fully understood from the following description of some preferred embodiments thereof, which is to be taken in conjunction with the accompanying drawings. It should be clearly understood, however, that the description of the embodiments, and the drawings, are all provided purely for the purpose of illustration and exemplification only, and are in no way to be taken as limitative of the scope of the present invention.

Figure 1:
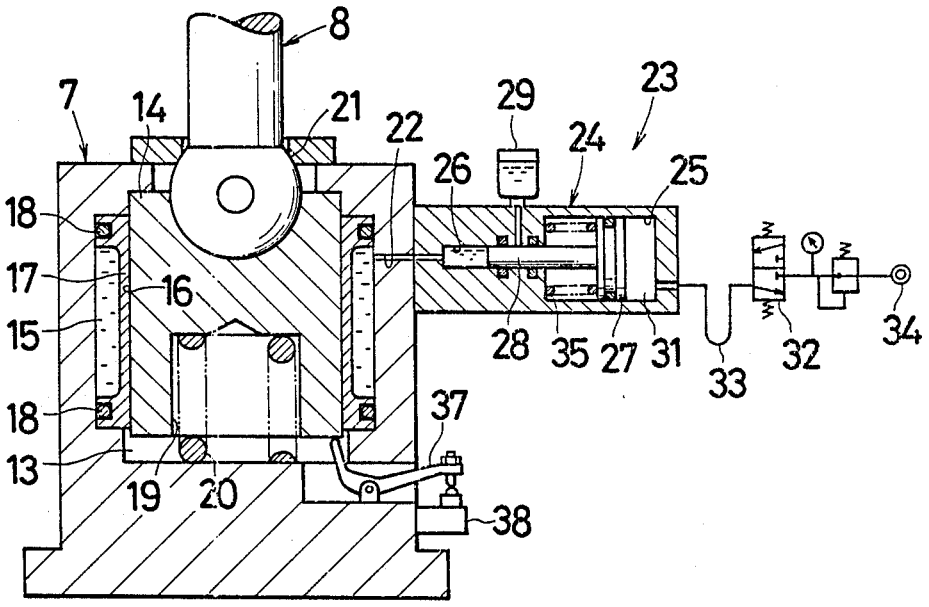
FIGS. 1 through 5 depict embodiments of a piston and slide of a hydraulic overload protector according to the present invention.
Figure 2:
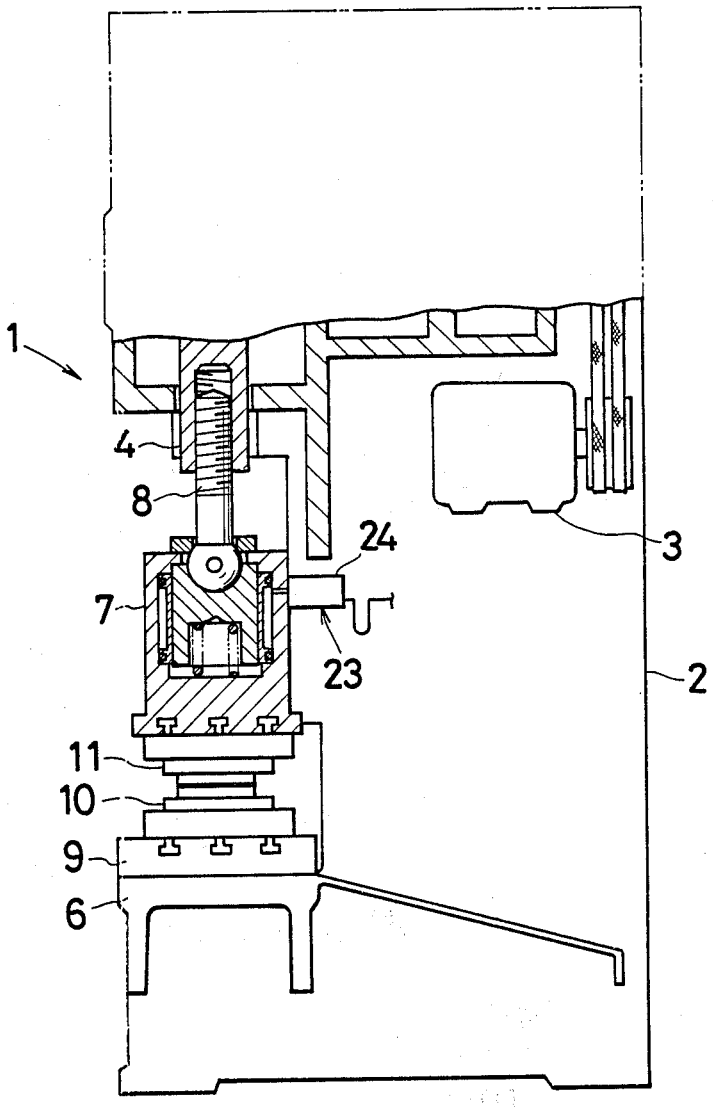

FIGS. 1 and 2 indicate one embodiment according to the present invention. FIG. 1 is an enlarged view of principal portions shown in FIG. 2. FIG. 2 is a vertical sectional side view of a mechanical press.

In FIG. 2, numeral 1 denotes a mechanical press and numeral 2, its frame. Electric motor 3 supported on an upper portion of frame 2 vertically reciprocates connecting rod 4 through a transmission device (not illustrated). On the front of frame 2, slide 7 is supported for free movement in the upward direction for bed 6, and slide 7 is interlocked with connecting rod 4 through slide adjusting screw 8. Bottom mold (i.e. die) 10 is mounted on bed 6 through die bolster 9 and top mold (i.e. die) 11 is mounted below slide 7.

A hydraulic overload-safe device is mounted in slide 7 as shown in FIG. 1.

Cylinder chamber 13 is formed in slide 7, and piston 14 is mounted in cylinder 13 so as to be vertically movable therein. Cylindrical operational oil chamber 15 is vertically formed between the outer circumferential surface of piston 14 and the inner circumferential face of cylinder chamber 13. The inner circumferential face of of cylindrical operational oil chamber 15 is surrounded by friction-contacting cylinder 17, and the outer circumferential face of cylinder 17 is fixed in an oil tight manner to the inner circumferential face of cylinder chamber 13 through an upper and lower O rings 18, 18. Friction-contacting circumferential face 16 provided on outer circumferential surface of piston 14 in integral relationship. The inner circumferential face 16 of friction-contacting cylinder 17 slidably contacts with the friction-contacting circumferential surface. It is preferable that friction-contacting circumferential face 16 is surface-treated and heat-treated in order to increase or stabilize its friction coefficient.

Spring mounting hole 19 projects upwards from the bottom of piston 14. Spring 20 is mounted between the bottom of hole 19 and the bottom of cylinder chamber 13. Spring 20 which is a compression spring urges piston 14 toward the top dead center of cylinder chamber 13. The upper portion of piston 14 is connected to the lower portion of slide adjusting screw 8 through ball joint 21.

When pressure oil is supplied from hydraulic supply device 23 to operational oil chamber 15 through oil supply-exhaust passage 22, the hydraulic force allows friction-contacting cylinder 17 to deform elastically in the radial inward direction thereof, with the result that friction-contacting cylinder 17 presses the friction-contacting circumferential surface of the piston. This operation frictionally fixes slide 7 to piston 14, so that pressure is transmitted to slide adjusting screw 8 from slide 7 through piston 14 in response to loading of top mold 11 during operation of the press.

Hydraulic supply device 23 will be described hereinafter.

Fixed to the upper circumferential face of slide 7 is booster 24 which comprises diametrically large pneumatic cylindrical chamber 25 and diametrically small hydraulic cylindrical chamber 26. Pneumatic piston 27 is inserted in a free airtight sliding manner into pneumatic cylindrical chamber 25. Hydraulic piston 28 which projects from pneumatic piston 27 is inserted into hydraulic cylindrical chamber 26 in an oil-tight sliding manner. Hydraulic cylinder chamber 26 communicates with operational oil chamber 15 provided in slide 7 through oil supply-exhaust passage 22. Numeral 29 denotes an oil tank for the supply of operational oil.

When compressed air is supplied from pneumatic source 34 to drive chamber 31 for pneumatic cylindrical chamber 25 through change-over valve 32 and flexible hose 33, pneumatic piston 27 is urged to the hydraulic cylindrical chamber 26 against the resilient force of the spring 35, with the result that hydraulic pressure increases in hydraulic cylindrical chamber 26. This hydraulic pressure, giving effect to operational oil chamber 15 of slide 7, allows piston 14 to be fixed to slide 7 at the top dead center of cylinder chamber 13 through friction-contacting cylinder 17.

During an overload-safe operation, on overload force applied to slide 7 is greater that the friction force generated by friction-contacting cylinder 17 as well as the resiliency of spring 20, causing piston 14 to descend relative to slide 7, the overload thereby being absorbed. In this case, even though pressure in operational oil chamber 15 rises above a predetermined value, pneumatic piston 27 is returned back in resistance to the pneumatic pressure in drive chamber 31 through the operation of hydraulic piston 28 of booster 24. Accordingly, the pressure in operational oil chamber 15 is kept constant.

Figure 6:
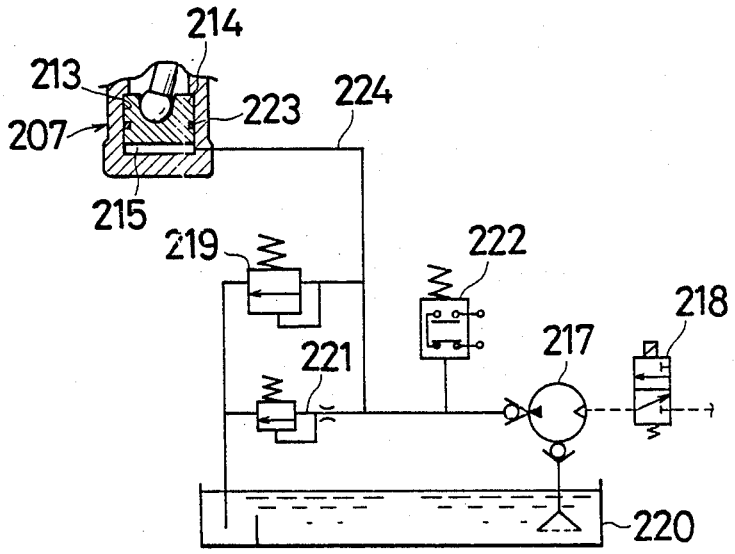
Fig. 6 PRIOR ART
FIG. 6 indicates a flow system of a conventional overload-safe equipment for mechanical press.

When piston 14 descends relative to slide 7 during an overload-safe operation, the bottom surface of piston 14 rotates oscillating lever 37, and the overload-safe operation can be detected by limit switch 38. Limit switch 38 is fixed to a lower portion of slide 7 to actuate the booster pump. For the hydraulic device 23, the booster 24 may be replaced with the booster pump 217 which is shown in the conventional embodiment (FIG. 6).

Figure 3:
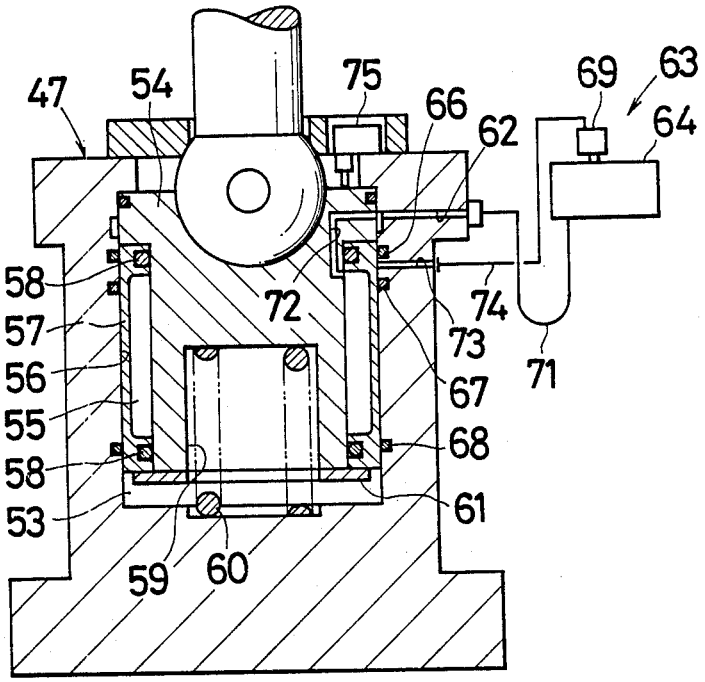
Figure 4:
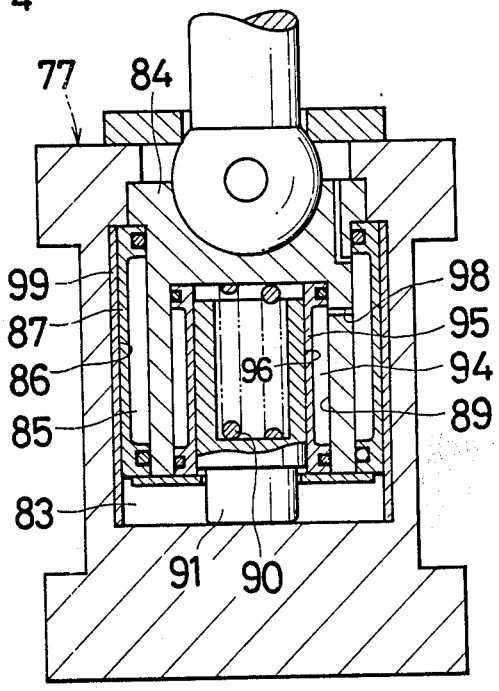
Figure 5:
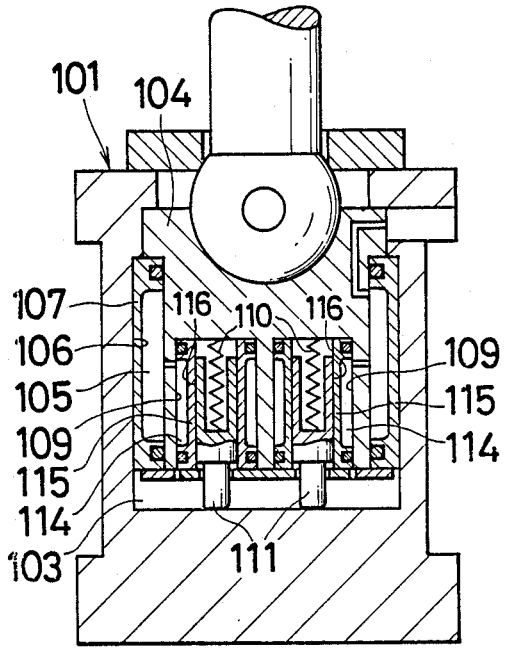

The hydraulic overload-safe devices shown in FIGS. 3 through 5 are different in the constructions thereof from that described above.

Cylinder chamber 53 in slide 47 as well as spring mounting hole 59, spring 60, and presser plate 61 shown in FIG. 3 are mounted on piston 54 in almost the same way as those shown in FIG. 1. The outer circumferential face of operational oil chamber 55 is covered with friction-contacting cylinder 57. Cylinder 57 is oil-tightly fixed to the outer circumferential surface of piston 54 through upper and lower O rings 58, 58 and presser plate 61. Friction-contacting circumferential face 56 is formed integrally with the peripheral wall of slide 47. The outer circumferential face of friction-contacting cylinder 57 contacts with friction-contacting circumferential face 56 in vertical sliding relationship. Booster 64 of hydraulic supply device 63 is connected to oil supply-exhaust passage 62 through hydraulic hose 71. Oil supply-exhaust passage 62 communicates with operational oil chamber 55 through communicating passage 72 formed in piston 54.

The space between friction-contacting circumferential face 56 and friction-contacting cylinder 57 is sealed oil-tightly by vertically mounted O rings 66, 67, and 68, and further, even though operational oil penetrates therebetween, it is returned to oil tank 69 through pressure relief hole 73 and return passage 74. The limit switch 75 is mounted on the slide 47 so that the contact thereof can be in contact with the top surface of the piston 54.

A hydraulic overload-safe device as shown in FIG. 4 is different in its construction from that shown in FIG. 3. The friction-fixing faces of of slide 77 and piston 84 are formed in and out of piston 84. Cylindrical spring washer 91 is inserted into spring mounting hole 89, and spring 90 is mounted between cylindrical spring washer 91 and piston 84, so that the bottom surface of cylindrical washer 91 is received by the bottom surface of cylindrical chamber 83. Cylindrical operational oil chamber 94 is formed between cylindrical spring washer 91 and the circumferential face of spring mounting hole 89. Friction-contacting cylinder 95 which covers the inner circumferential face of operational oil chamber 94 vertically slidably contacts with friction-contacting circumferential face 96 formed on the outer circumferential face of spring washer 91. Outer operational oil chamber 85 communicates with inner operational oil chamber 94 through communicating passage 98. Outer friction-contacting cylinder 87 is fixed to piston 84 almost in the same manner as that shown in FIG. 3, however, outer friction-contacting circumferential face 86 is formed with dry friction rust-proof sleeve 99 which is engaged with the circumferential face of cylindrical chamber 83. Friction-contacting circumferential face 86 may also be formed by lining or coating the circumferential face of cylinder chamber 83 with friction-promoting material.

A hydraulic overload-safe device as shown in FIG. 5 is a modification of the one shown in FIG. 4. A plurality of friction-contacting cylinders 115 and friction-contacting circumferential faces 116 are mounted in piston 104, however, slide 101, piston 104, operational oil chamber 105 formed outside piston 104, friction-contacting circumferential face 106, and friction-contacting cylinder 107 are formed almost in the same manner as those shown in FIG. 4.

A plurality of spring mounting holes 109 are formed in the lower portion of piston 104 in the circumferential direction thereof. Spring 110 and spring washer 111 are inserted into each of spring mounting holes 109. Cylindrical operational oil chamber 114 and friction-contacting cylinder 115 are mounted between spring washer 111 and piston 104. Numeral 116 denotes friction-contacting circumferential face.

According to the embodiments as shown in FIGS. 4 and 5, friction-fixing faces are formed in and out of the respective pistons, however, according to this embodiment, they may be only inside piston 104.

What is claimed is:

1. In a hydraulic overload protector for a mechanical press having a cylinder chamber formed in a slide of said mechanical press, a piston vertically movable in the cylinder chamber, and an operation oil chamber formed between the piston and the slide, wherein the piston is fixed to the slide at a top dead center of the cylinder chamber by the hydraulic pressure in the operational oil chamber; the improvement comprising a friction contacting cylinder within the slide and wherein the operational oil chamber has a circumferential face sealed at opposite ends thereof with said friction-contacting cylinder, said friction-contacting cylinder slidably contacting with a friction-contacting circumferential surface of one of said piston and said slide, and the friction-contacting cylinder is fixed between the slide and the piston to frictionally fix the slide to the piston by pressing of the friction-contacting cylinder onto the friction-contacting circumferential surface by hydraulic pressure in the operational oil chamber.

2. In a hydraulic overload protector for a mechanical press as claimed in claim 1, wherein the oprational oil chamber is formed in a space between an outer circumferential face of the piston and the circumferential face of the cylinder chamber.

3. In a hydraulic overload protector for a mechanical press as claimed in claim 1, wherein the circumferential face of the operational oil chamber is sealed with the friction-contacting cylinder, and the friction-contacting cylinder is fixed to the slide.

4. A hydraulic overload protector for mechanical press as claimed in claim 1, wherein an outer circumferential face of the operational oil chamber is sealed with the friction-contacting cylinder, and the friction-contacting cylinder is fixed to the piston, and the friction-contacting circumferential face is fixed to the slide.

5. A hydraulic overload protector for mechanical press as claimed in claim 1, wherein a spring mounting hole is formed upwards from a bottom of the piston, and a spring and a spring washer is inserted into the spring mounting hole, the bottom surface of the spring washer received by a bottom surface of the cylinder chamber, and a second operational oil chamber is formed in the space between the outer circumferential face of the spring washer and the spring mounting hole.

6. A hydraulic overload protector for mechanical press as claimed in claim 5, wherein a plurality of spring mounting holes are formed in the lower portion of a piston in the circumferential direction thereof, and a spring as well as a spring washer is inserted into the respective spring mounting hole, and a plurality of said second operational oil chambers are respectively formed in the space between the respective spring washer and the circumferential face of the respective spring mounting hole.

7. A hydraulic overload protector for mechanical press as claimed in claim 1, wherein a rust-proof sleeve is fixed to a slide or a piston and the friction-contacting circumferential surface is composed of the rust-proof sleeve.

8. A hydraulic overload protector for mechanical press as claimed in claim 1, wherein the friction-contacting circumferential surface is composed of lining material or coating material.

9. A hydraulic overload protector for mechanical press as claimed in claim 1, wherein a limit switch is fixed to the slide for detecting the sliding movement of the piston relative to the slide in resistance to the piston-fixing force generated by the friction between a friction-contacting cylinder and a friction-contacting circumferential surface during an overload-safe operation.

* * * * *